US010132515B2

(12) United States Patent
Smith

(10) Patent No.: US 10,132,515 B2
(45) Date of Patent: Nov. 20, 2018

(54) AIR CURTAIN ARRANGEMENT FOR AN APPLIANCE, AND ASSOCIATED APPARATUS AND METHOD

(71) Applicant: ELECTROLUX HOME PRODUCTS, INC., Charlotte, NC (US)

(72) Inventor: Stephen M. Smith, Charlotte, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 326 days.

(21) Appl. No.: 14/950,844

(22) Filed: Nov. 24, 2015

(65) Prior Publication Data

US 2017/0146255 A1 May 25, 2017

(51) Int. Cl.

| | |
|---|---|
| ***F24F 9/00*** | (2006.01) |
| ***F25D 23/02*** | (2006.01) |
| ***F24C 15/02*** | (2006.01) |
| ***D06F 37/28*** | (2006.01) |
| ***D06F 37/42*** | (2006.01) |
| ***A47L 15/42*** | (2006.01) |

(52) U.S. Cl.

CPC ..... *F24F 9/00* (2013.01); *A47L 15/4257* (2013.01); *D06F 37/28* (2013.01); *D06F 37/42* (2013.01); *F24C 15/025* (2013.01); *F25D 23/023* (2013.01); *D06F 2224/00* (2013.01)

(58) Field of Classification Search

CPC ..... F24C 15/006; F24C 15/025; F24F 9/00; A49L 15/4257

USPC ..... 454/188–193

See application file for complete search history.

(56) References Cited

U.S. PATENT DOCUMENTS

| | | | | |
|---|---|---|---|---|
| 3,310,046 A | | 3/1967 | Scott et al. | |
| 3,387,600 A | * | 6/1968 | Terzian | F24C 15/006 110/179 |
| 3,859,499 A | * | 1/1975 | Evans | F24C 14/02 126/21 A |
| 3,889,099 A | * | 6/1975 | Nuss | F24C 15/006 126/198 |
| 4,043,319 A | * | 8/1977 | Jensen | B05B 15/1222 126/299 D |

(Continued)

FOREIGN PATENT DOCUMENTS

CN 1995837 A 7/2007

*Primary Examiner* — Vivek Shirsat

(74) *Attorney, Agent, or Firm* — Womble Bond Dickinson (US) LLP

(57) ABSTRACT

An appliance includes a housing defining a cavity having an opening, and a cover member pivotable between open and closed positions with respect to the opening to selectively allow access to the cavity through the opening. A plurality of vents is engaged with the housing about the opening, including a positive pressure vent configured to direct a positive airflow in a first lateral cross-opening direction, a negative pressure vent configured to apply a suction in a second lateral cross-opening direction to pull at least a portion of the positive airflow therethrough, and opposing first and second neutral vents arranged laterally across the opening and configured to neutralize effects on and maintain the positive airflow from the positive pressure vent and pulled through the negative pressure vent by the applied suction caused by the cover member pivoting between open and closed positions. An associated apparatus and method are also provided.

24 Claims, 6 Drawing Sheets

(56) References Cited

U.S. PATENT DOCUMENTS 4,379,391 A * 4/1983 Rhee ..... F25D 23/023 62/255
4,547,642 A * 10/1985 Smith ..... F24C 14/00 126/21 A
4,616,562 A 10/1986 Kuechler
4,686,891 A * 8/1987 Pouchard ..... F24F 13/12 126/193
4,898,319 A * 2/1990 Williams ..... F27B 17/0016 219/214
4,927,438 A * 5/1990 Mears ..... F24F 3/1607 454/56
5,113,749 A * 5/1992 Perbix ..... F24F 9/00 454/193
6,874,331 B2 * 4/2005 Chandler ..... A47F 3/0447 454/193
7,228,857 B2 6/2007 Kim et al.
7,357,131 B2 * 4/2008 Moreth, III ..... F23M 7/00 126/193
7,547,862 B2 * 6/2009 Kim ..... F24C 15/006 126/193
8,006,687 B2 8/2011 Watkins et al.
8,173,942 B2 5/2012 Wiseman et al.
8,746,230 B2 6/2014 Trautner et al.
2005/0133019 A1 * 6/2005 Kim ..... F24C 15/006 126/198
2005/0224068 A1 * 10/2005 Kim ..... F24C 15/006 126/198
2007/0125760 A1 * 6/2007 Kim ..... F24C 15/006 219/391
2007/0163567 A1 * 7/2007 Kaneko ..... F24C 15/006 126/21 A
2007/0184769 A1 * 8/2007 Lin ..... B08B 15/02 454/57
2008/0184985 A1 * 8/2008 Hasslberger ..... F24C 15/006 126/21 R
2010/0101556 A1 * 4/2010 Dell'Oglio ..... F24C 15/006 126/21 A
2010/0267321 A1 * 10/2010 Huang ..... B08B 15/023 454/56
2012/0152223 A1 * 6/2012 Sillmen ..... F24C 7/08 126/21 A
2014/0196612 A1 * 7/2014 Kamii ..... F24C 7/02 99/447

* cited by examiner

AIR CURTAIN ARRANGEMENT FOR AN APPLIANCE, AND ASSOCIATED APPARATUS AND METHOD

BACKGROUND

Field of the Disclosure

The present disclosure generally relates to appliances and, more particularly, to an air curtain arrangement for an appliance having a housing defining an opening and engaged with a cover member, and associated apparatus and method.

Description of Related Art

An air curtain arrangement may be implemented on some appliances to maintain an environment within the appliance housing, when a lid, door, or cover member associated with that appliance is opened. For example, such an air curtain may be implemented in an oven in order to reduce the amount of steam hitting the user's face when opening the oven door. In general, the air curtain may be achieved by directing a stream or sheet of air parallel to the opening of the oven that is normally closed by the oven door. Such an arrangement may reduce the escape of heat and steam from within the oven.

One possible issue with such an air curtain arrangement may be that the stream or sheet of air directed parallel to the opening of the appliance, when the door thereof is opened, may diffuse and disperse toward the side of the opening opposite to the side from which the air is emitted. As such, the efficacy of the air curtain may be more significant toward the air-emission side of the opening, and less significant toward the opposing side of the opening across which the air is directed.

Another possible issue is that the side of the opening receiving the stream or sheet of air directed across the opening may not necessarily be configured to prevent diffusion or dispersion of the air curtain. That is, the air curtain, upon reaching the opposed end of the opening, may be deflected by the structure and thus be deflected or dispersed about that end of the opening. Such deflection, dispersion, or diffusion may therefore cause the air curtain to be less effective.

Such weaknesses in the air curtain may be more pronounced when the door or other cover member sealing the opening is opened or closed with respect to the opening. For example, when the door of an appliance is opened or closed, the change in pressure about the opening of the housing/cavity of the appliance may cause the air curtain to be pushed into the housing or pulled outwardly of the housing. Any such deformation and/or re-direction of the air curtain may adversely affect the efficacy of the sheet/stream of air, either causing escape of the internal environment from the housing or ingress of the external environment into the housing.

Accordingly, there exists a need for a more effective air curtain arrangement that is more capable of retaining the integrity of the sheet/stream of air forming the air curtain, particularly upon the door/cover member of the appliance being opened and/or closed. In addition, it may be preferable that such an air curtain arrangement be capable of being readily integrated into various appliances that could benefit from an air curtain, or otherwise be capable of being retrofit to such appliances.

SUMMARY OF THE DISCLOSURE

The above and other needs are met by aspects of the present disclosure which, in one aspect, provides an appliance, comprising a housing defining a cavity having an opening, and a cover member engaged with the housing and configured to be pivotable between an open position and closed position with respect to the opening, so as to selectively allow access to the cavity through the opening. A plurality of vents is operably engaged with the housing about the opening. The plurality of vents provides first, second and third airflow manipulations. A positive pressure vent is configured direct a positive airflow therethrough in a first lateral direction across the opening for the first airflow manipulation. A negative pressure vent is configured to apply a suction in a second lateral direction across the opening so as to pull at least a portion of the positive airflow therethrough for the second airflow manipulation. Opposing first and second neutral vents are arranged laterally across the opening to provide the third airflow manipulation, in response to pivoting of the cover member between the open and closed positions with respect to the opening, by neutralizing effects on and maintaining the positive airflow directed across the opening from the positive pressure vent and pulled through the negative pressure vent by the applied suction, caused by pivoting of the cover member between the open and closed positions.

Another aspect of the disclosure provides an air curtain arrangement for an appliance, wherein the appliance includes a housing defining a cavity having an opening, and a cover member engaged with the housing, with the cover member being configured to be pivotable between an open position and closed position with respect to the opening so as to selectively allow access to the cavity through the opening. The air curtain arrangement comprises a positive pressure vent configured direct a positive airflow therethrough in a first lateral direction across the opening. A negative pressure vent is configured to apply a suction in a second lateral direction across the opening so as to pull at least a portion of the positive airflow therethrough. Opposing first and second neutral vents are arranged laterally across the opening. The first and second neutral vents are configured to be responsive to pivoting of the cover member between the open and closed positions with respect to the opening, so as to neutralize effects on and maintain the positive airflow directed across the opening from the positive pressure vent and pulled through the negative pressure vent by the applied suction, caused by pivoting of the cover member between the open and closed positions.

A further aspect of the disclosure provides a method of manufacturing an appliance, wherein the appliance includes a housing defining a cavity having an opening, and a cover member engaged with the housing and configured to be pivotable between an open position and closed position with respect to the opening so as to selectively allow access to the cavity through the opening. The method comprises engaging a positive pressure vent with the housing, wherein the positive pressure vent is configured to direct a positive airflow therethrough in a first lateral direction across the opening. A negative pressure vent is engaged with the housing, wherein the negative pressure vent is configured to apply suction in a second lateral direction across the opening so as to pull at least a portion of the positive airflow from the positive pressure vent therethrough. Opposing first and second neutral vents are engaged with the housing, such that the opposing first and second neutral vents are arranged laterally across the opening. The first and second neutral vents are configured to be responsive to pivoting of the cover member between the open and closed positions with respect to the opening, to neutralize effects on and maintain the positive airflow directed across the opening from the positive pressure vent and pulled through the negative pressure vent by the applied suction, caused by pivoting of the cover member between the open and closed positions.

Further features and advantages of the present disclosure are set forth in more detail in the following description.

BRIEF DESCRIPTION OF THE DRAWINGS

Figure 1:
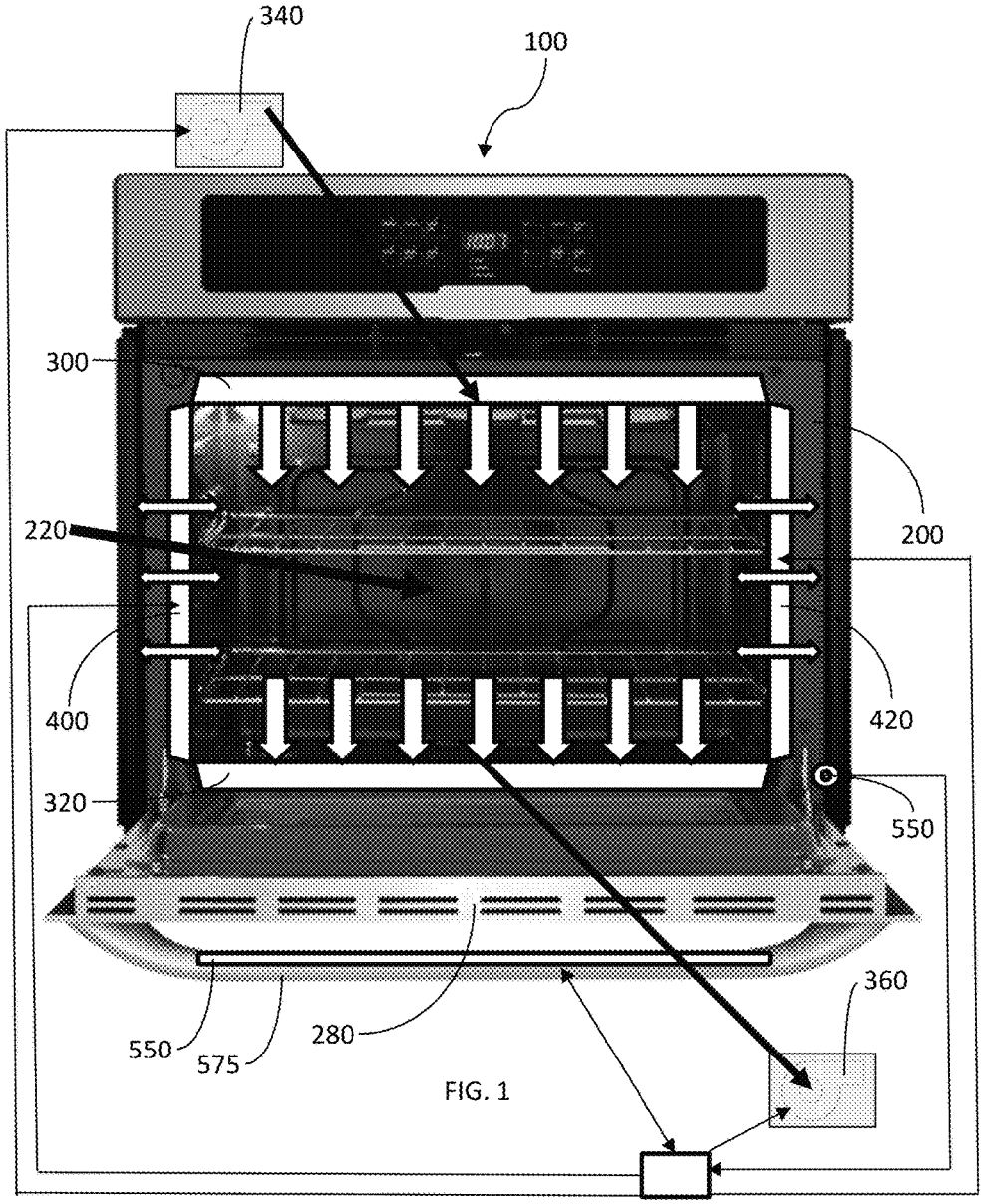
Figure 2:
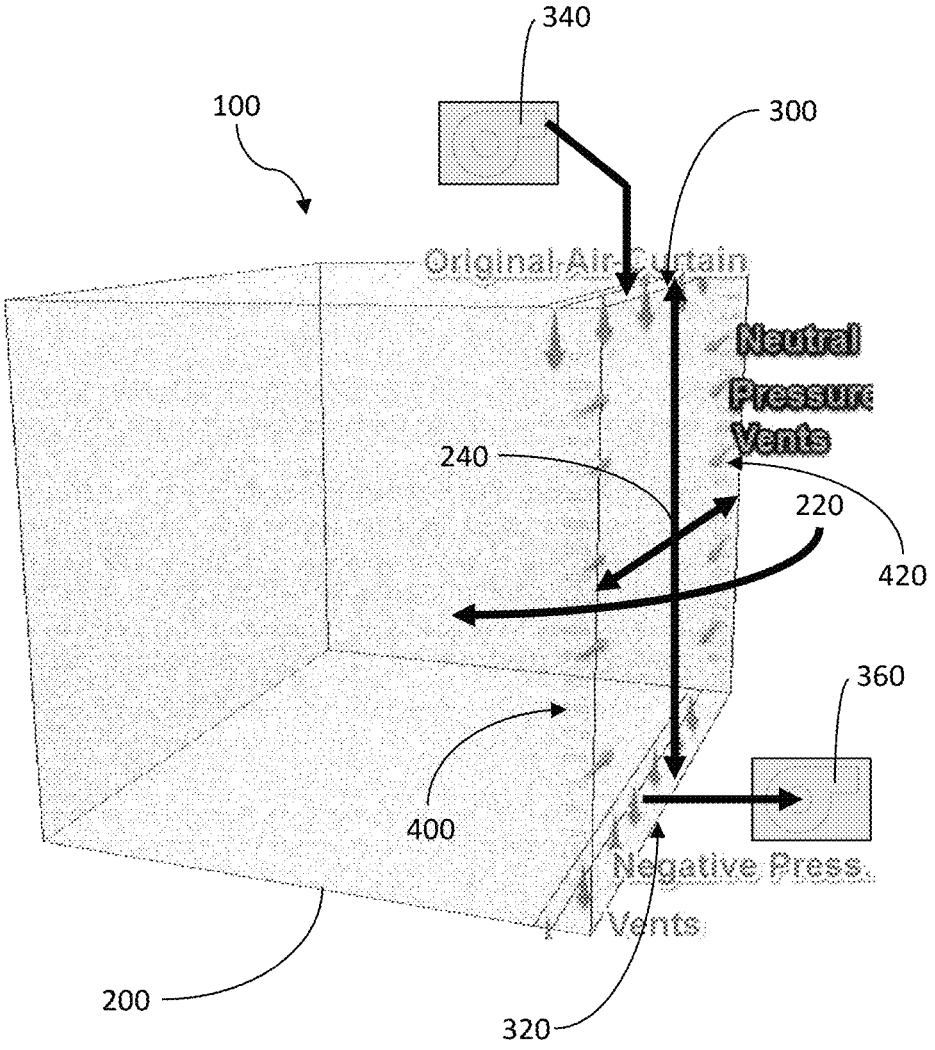
Figure 2A:
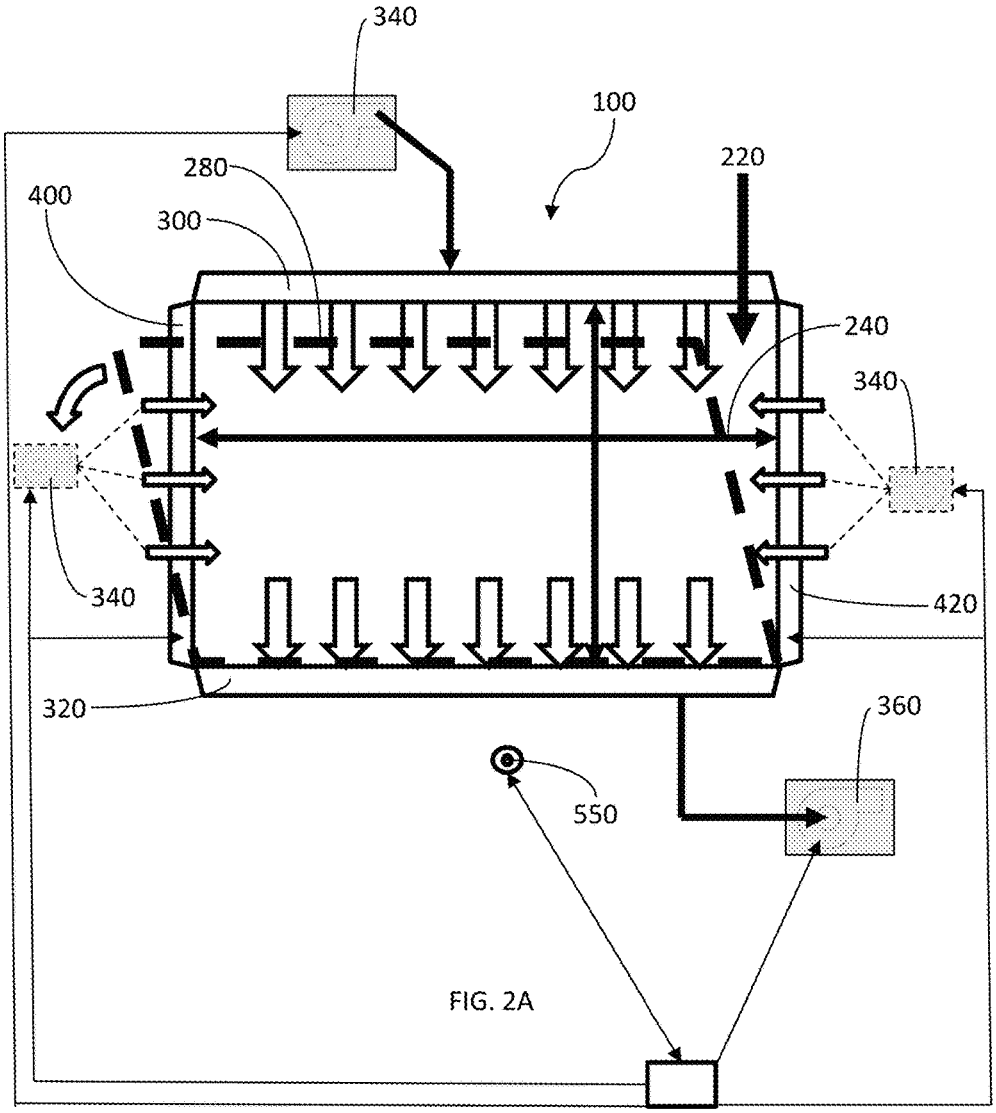
Figure 2B:
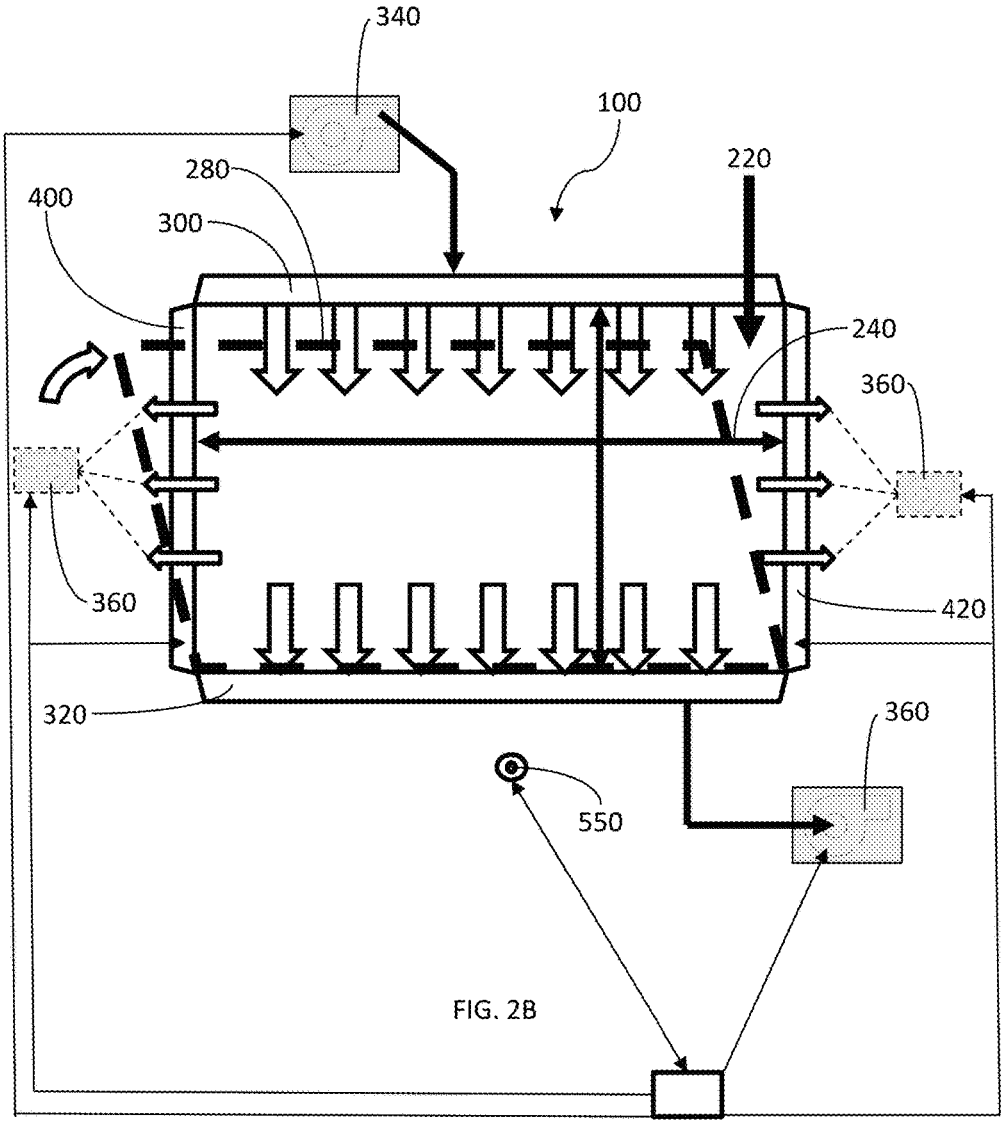
Figure 3:
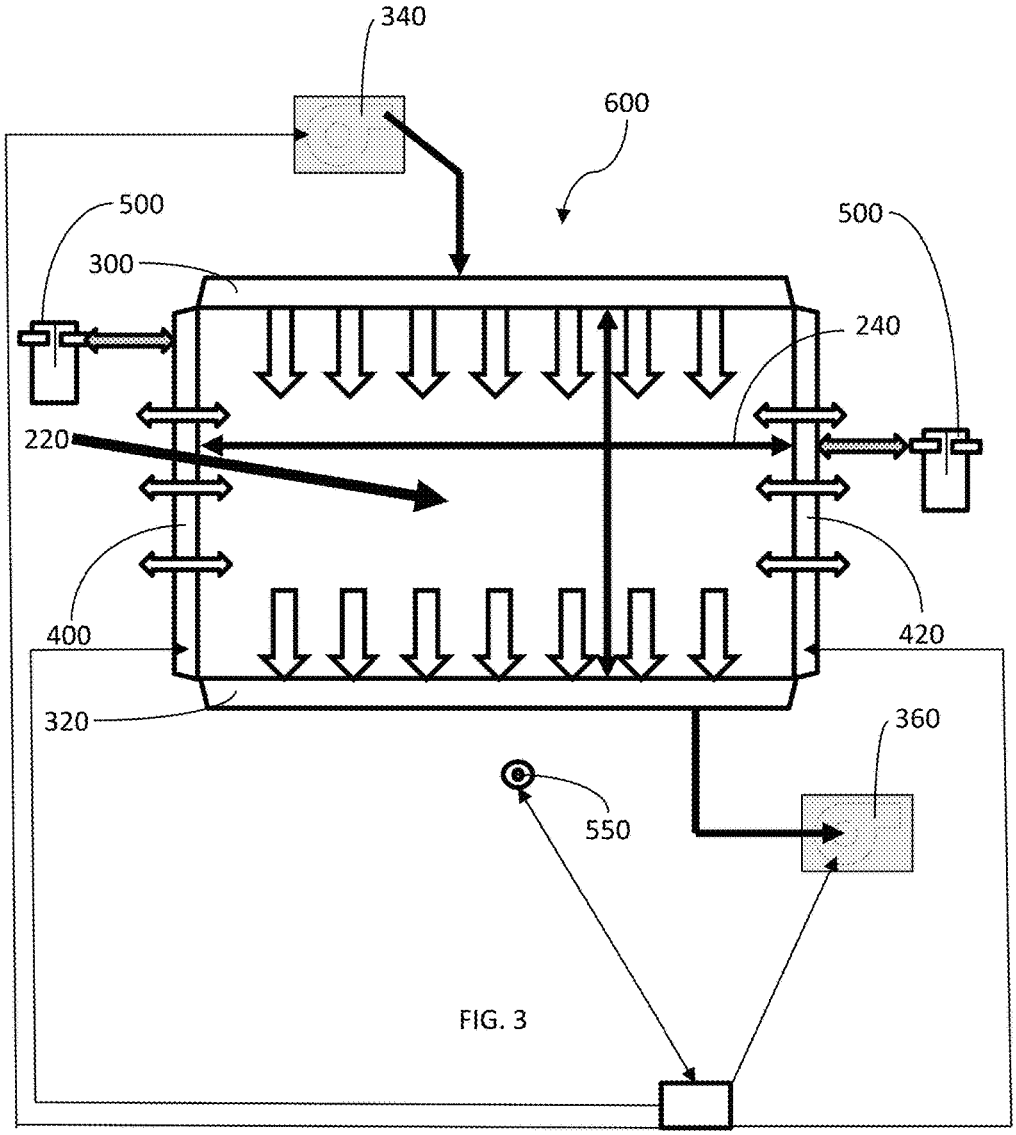
Figure 4:
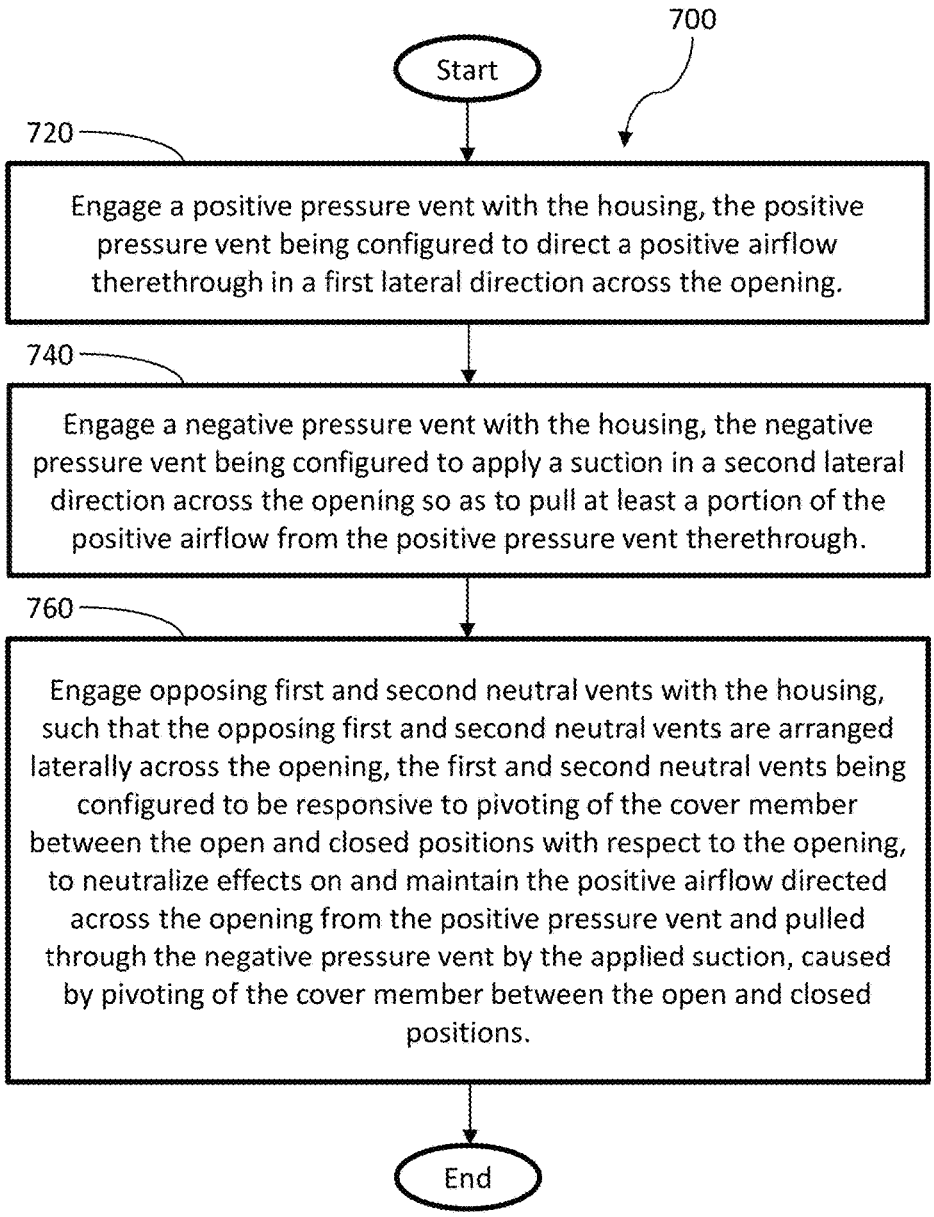

Having thus described the disclosure in general terms, reference will now be made to the accompanying drawings, which are not necessarily drawn to scale, and wherein:

FIG. 1 schematically illustrates an oven as an exemplary appliance implementing an air curtain arrangement, according to one aspect of the present disclosure; and FIG. 2 schematically illustrates an appliance implementing an air curtain arrangement, according to one aspect of the present disclosure;

FIG. 2A schematically illustrates an appliance implementing an air curtain arrangement, according to one aspect of the disclosure as shown in FIG. 2, with the neutralizing vents directing a positive airflow between the cover member and the opening upon the cover member pivoting from the closed position to the open position:

FIG. 2B schematically illustrates an appliance implementing an air curtain arrangement, according to one aspect of the disclosure as shown in FIG. 2, with the neutralizing vents directing a negative airflow from between the cover member and the opening upon the cover member pivoting from the open position to the closed position;

FIG. 3 schematically illustrates an air curtain arrangement for an appliance, according to one aspect of the present disclosure; and FIG. 4 schematically illustrates a flowchart of a method of manufacturing an appliance, according to one aspect of the present disclosure.

DETAILED DESCRIPTION OF THE DISCLOSURE

The present disclosure now will be described more fully hereinafter with reference to the accompanying drawings, in which some, but not all aspects of the disclosure are shown. Indeed, the disclosure may be embodied in many different forms and should not be construed as limited to the aspects set forth herein; rather, these aspects are provided so that this disclosure will satisfy applicable legal requirements. Like numbers refer to like elements throughout.

FIGS. 1, 2, 2A, and 2B each schematically illustrate a representative appliance, such as an oven, indicated generally by the numeral 100. Such an appliance 100 may comprise any appliance having a housing 200 defining a cavity 220 having an opening 240, and wherein a cover member 280 is engaged with the housing 200, and is configured to be movable between an open position and closed position with respect to the opening 240, so as to selectively allow access to the cavity 220 through the opening 240. In one aspect, the cover member 280 may be pivotably attached to or engaged with the housing 200 about the opening 240, such that the cover member 280 can be pivoted between a closed position and an open position to selectively allow access to the cavity 220 via the opening 240. Appliances 100 demonstrating such a housing 200 and associated cover member 280 include, for example, an oven, a refrigerator, a wine cooler, a freezer, an icemaker, a dishwasher, a clothes washer, a clothes dryer, or a clothes steamer. The appliance 100 may be household/domestic appliances or professional/commercial appliances. In any instance, the exemplary appliances disclosed herein are not intended to be limiting in any manner.

Such appliances, in use or operation, have or maintain a particular environment within the cavity 220 defined by the housing 200 that, in certain instances, differs from the surrounding environment. For example, a freezer may maintain a temperature at or below freezing within the cavity, while a clothes steamer may require a certain elevated temperature and humidity to be maintained within the cavity. Such an environment internal to the housing/within the cavity may be disrupted when the cover member (i.e., door or lid) is opened and/or closed with respect to the opening 240. Accordingly, aspects of the present disclosure may provide that such appliances include an air curtain arrangement disposed about the opening 240 so as to provide a barrier for maintaining the environment within the cavity 220 when the cover member 280 is moved to the open position with respect to the opening 240.

In particular aspects, the air curtain arrangement may comprise a plurality of vents operably engaged with the housing 200 about the opening 240, wherein each of the plurality of vents provides a separate airflow manipulation. In one instance, the air curtain arrangement may include a positive pressure vent 300 configured to direct a positive airflow therethrough in a first lateral direction across the opening 240, so as to provide a first airflow manipulation. In particular instances, the air curtain arrangement may also include a negative pressure vent 320 configured to apply a suction in a second lateral direction across the opening 240 so as to pull at least a portion of the positive airflow therethrough, and thereby providing a second airflow manipulation. For example, when implemented in an appliance, such as a refrigerator, the positive pressure vent 300 may be disposed at the upper end of the housing 200, about the opening 240, and arranged to direct a positive pressure airflow vertically downward. In such, instances, the negative pressure vent 320 may be disposed at the lower end of the housing 200, about the opening 240, and arranged to pull a suction therethrough from in the vertical direction, wherein the suction may be arranged to act upon the positive pressure airflow from the positive pressure vent 300 so as to draw the positive pressure airflow therethrough. In this manner, an air curtain or sheet may be formed in the vertical direction between the upper and lower ends of the housing, about the opening 240, and extending across the width of the opening 240. The air curtain may thus function as a de facto barrier separating the environment within the housing 200 from ambient when the cover member 280 (i.e., the door of the refrigerator) is pivoted to the open position. Accordingly, the cold environment within the housing 200 may be at least partially retained or contained when the door of the refrigerator is opened, possibly lowering energy bills. In this regard, one skilled in the art will appreciate that the airflow may not necessarily need to be directed vertically, but that the orientation of the airflow may vary depending on the configuration of the appliance. For example, in the case of a chest freezer, wherein the lid or door pivots about a horizontal axis, the first and second airflow manipulations (i.e., positive pressure/flow and opposing suction) may be arranged for to direct the airflow in the horizontal plane.

However, when the cover member 280 is pivoted between the open and closed positions, the opening and closing motion of the cover member 280 may create pressure changes between the cover member 280 and the cavity 220 defined by the housing 200. Such pressure changes may tend to distort or deflect the air curtain provided by the first and second airflow manipulations and therefore interrupt the containment or retention of the environment within the cavity 220 defined by the housing 200. As such, in some aspects of the present disclosure, opposing first and second neutral vents 400, 420 may be arranged laterally across the opening 240 to provide the third airflow manipulation, in response to pivoting of the cover member 280 between the open and closed positions with respect to the opening 240, by neutralizing effects on and maintaining the air curtain formed by the first and second airflow manipulations. That is, the third airflow manipulation is configured to neutralize or counteract the distortion or deflection of the positive airflow directed across the opening 240 from the positive pressure vent 300 and pulled through the negative pressure vent 320 by the applied suction, caused by pivoting of the cover member 280 between the open and closed positions.

In particular aspects, the positive pressure vent 300 is laterally opposed to the negative pressure vent 320. In other aspects, the first and second neutral vents 400, 420 are arranged to be directed perpendicularly to the positive and negative pressure vents 300, 320. That is, in accordance with the refrigerator example previously disclosed, the first and second neutral vents 400, 420 may be arranged in opposition to each other along the opposing vertical sides of the opening 240. That is, one of the first and second neutral vents 400, 420 may be arranged along one vertical side of the opening 240, while the other of the first and second neutral vents 400, 420 may be arranged along the other vertical side of the opening 240. Since the first and second neutral vents 400, 420 are configured to neutralize or counteract the distortion or deflection of the positive airflow directed across the opening 240 from the positive pressure vent 300 and pulled through the negative pressure vent 320 by the applied suction, caused by pivoting of the cover member 280 between the open and closed positions, each of the first and second neutral vents 400, 420 may be configured to direct a positive airflow therethrough, to apply a suction therethrough, to allow egress of air from between the cover member 280 and the opening 240 to an exterior of the housing 200, or to allow ingress of air from the exterior of the housing 200 to between the cover member 280 and the opening 240, as the third airflow manipulation.

In some instances, the first neutral vent 400 and/or the second neutral vent 420 may be active vents. That is, the particular active vent may be configured to have a positive airflow therethrough, or to have a suction applied therethrough, similarly to the positive pressure vent 300 and the negative pressure vent 320. Accordingly, such instances of "active" neutral vents may include a positive airflow source (see, e.g., FIGS. 1, 2, 2A, 2B, and 3, element 340), or a suction source (see, e.g., FIGS. 1, 2, 2A, 2B, and 3, element 360), associated therewith (i.e., an appropriately configured fan, blower, etc.). In other aspects, the first neutral vent 400 and/or the second neutral vent 420 may be passive vents. That is, the particular passive vent may be configured to allow egress of air from between the cover member 280 and the opening 240 to an exterior of the housing 200, or to allow ingress of air from the exterior of the housing 200 to between the cover member 280 and the opening 240. In further aspects, the first neutral vent 400 may be a passive vent, while the second neutral vent 420 may be active vent, or vice versa.

Since there may be a significant temperature differential between the air or environment external to the housing 200, and the air or environment between the cover member 280 and the opening 240, where necessary or desired, a condensate trap 500 (see, e.g., FIG. 3) may be operably engaged with the first neutral vent 400 and/or the second neutral vent 420 for removing moisture from the air directed therethrough. If necessary or desired, such a condensate trap may also be operably engaged with the positive pressure vent 300 and/or the negative pressure vent 320 for the same purpose.

In some aspects of the present disclosure, the appliance may further include an actuator 550 (see, e.g., FIGS. 1, 2, 2A, 2B, and 3) configured to be in communication with and capable of actuating the positive pressure vent 300, the negative pressure vent 320, the first neutral vent 400 and/or the second neutral vent 420. For example, such an actuator 550 may be engaged with the cover member 280, with the housing 200, or between the cover member 280 and the housing 200. In another example, the actuator may be engaged with a handle 575 (see, e.g., FIG. 1) associated with the cover member 280 of the appliance 100, wherein the actuator 550 may be, for instance, a capacitive sensor configured to determine when a user has engaged the handle 575 to open or close the cover member 280. In any instance, the actuator 550 may be configured to cooperate with active vents (i.e., the positive pressure vent 300 and/or the negative pressure vent 320) to actuate the airflow source for providing the positive airflow or to actuate the suction source for providing the suction, in response to the cover member 280 being pivoted from the closed position toward the open position, and to deactuate the airflow source or the suction source in response to the cover member 280 being pivoted from the open position to the closed position.

The actuator 550 may further be configured to cooperate with passive vents (i.e., the first and second neutral vents 400, 420) to open one or more of the plurality of vents in response to the cover member 280 being pivoted from the closed position toward the open position, and to close the one or more of the plurality of vents in response to the cover member 280 being pivoted from the open position to the closed position.

Aspects of the present disclosure thus provide an air curtain arrangement that can be integrated into an appliance or installed as a retrofit to an existing appliance, with the applicable appliances being of the types disclosed herein. In such retrofit instances, the air curtain arrangement 600 (see, e.g., FIG. 3) may comprise a positive pressure vent 300 adapted to be engaged with a first edge of a housing 200 defining an opening 240 to a cavity 220, wherein the positive pressure vent 300 is configured to direct a positive airflow therethrough in a first lateral direction across the opening 240. A negative pressure vent 320 is adapted to be engaged with a second edge of the housing 200 defining the opening 240 to the cavity 220, wherein the negative pressure vent 320 is configured to apply a suction in a second lateral direction across the opening 240 so as to pull at least a portion of the positive airflow from the positive pressure vent 300 therethrough. Opposing first and second neutral vents 400, 420 are adapted to engage third and fourth edges of the housing 200 defining the opening 240 to the cavity 220, so as to be arranged laterally across the opening 240, wherein the first and second neutral vents 400, 420 are configured to be responsive to pivoting of the cover member 280 between the open and closed positions with respect to the opening 240, to neutralize effects on and maintain the positive airflow directed across the opening 240 from the positive pressure vent 300 and pulled through the negative pressure vent 320 by the applied suction, caused by pivoting of the cover member 280 between the open and closed positions.

Other aspects of the disclosure may provide a method of manufacturing an appliance 100, as shown in FIG. 4, the appliance 100 including a housing 200 defining a cavity 220 having an opening 240, and a cover member 280 engaged with the housing 200 and configured to be pivotable between an open position and closed position with respect to the opening 240 so as to selectively allow access to the cavity 220 through the opening 240. Such a method may comprise engaging a positive pressure vent 300 with the housing 200, wherein the positive pressure vent 300 is configured to direct a positive airflow therethrough in a first lateral direction across the opening 240 (block 720). A negative pressure vent 320 is also engaged with the housing 200, wherein the negative pressure vent 320 is configured to apply a suction in a second lateral direction across the opening 240 so as to pull at least a portion of the positive airflow from the positive pressure vent 300 therethrough (block 740). Opposing first and second neutral vents 400, 420 are engaged with the housing 200, such that the opposing first and second neutral vents 400, 420 are arranged laterally across the opening 240. The first and second neutral vents 400, 420 are configured to be responsive to pivoting of the cover member 280 between the open and closed positions with respect to the opening 240, to neutralize effects on and maintain the positive airflow directed across the opening 240 from the positive pressure vent 300 and pulled through the negative pressure vent 320 by the applied suction, caused by pivoting of the cover member 280 between the open and closed positions (block 760).

The air curtain disclosed herein thus provided multiple air flow patterns or manipulations for separating the internal environment of an appliance from the external environment when the cover member 280 (i.e., door, lid, etc.) is open. By providing a negative pressure vent opposite to the positive pressure vent, a more robust air curtain may be realized. In one example, the positive pressure vent may be disposed and arranged about a top edge of the opening to an oven, and the negative pressure vent may be disposed and arranged about the bottom edge of the opening (i.e., the edge along which the oven door pivots to open and close). In addition, the provision of first and second neutral pressure vents in opposing relation along the edges of the opening disposed orthogonally to the top and bottom edges, and on the outside of the flow path of the air curtain flow path, relieves the positive or negative air pressure/airflow into or out of the cavity defined by the housing as a result of the cover member being opened and closed. For example, the first and second neutral vents may be arranged along the vertical edges of the opening so as to relieve pressure changes caused by the oven door being opened and closed, thereby maintaining the air curtain in a relatively planar form. That is, the first and second neutral vents along the side edges of the oven opening may be configured and arranged to allow the volume of air between the door and the opening to the oven cavity to either escape to the external environment prior to that volume of air pushing the air curtain into the oven cavity when the oven door is being closed, or to provide "make up" or supplemental air between the door and the opening to the oven cavity, in response to the negative pressure produced by the oven door being opened, and thereby preventing the air curtain from being pulled outward of the oven cavity when the oven door is being opened. The net effect of these multiple air flow manipulations is thus to reduce the amount of loss from within the appliance cavity (i.e., reduced loss of heat from the oven). In the example of the oven, retaining the heat within the oven cavity (or reducing the heat loss from the cavity) may lead to increased cooking uniformity within the oven, may lessen the time needed for the oven to reheat/recover from the door being opened, and may potentially reduce energy consumption while accelerating the cooking process.

Many modifications and other aspects of the disclosures set forth herein will thus come to mind to one skilled in the art to which these disclosures pertain having the benefit of the teachings presented in the foregoing descriptions and the associated drawings. For example, those of skill in the art will appreciate that embodiments not expressly illustrated herein may be practiced within the scope of the present disclosure, including that features described herein for different embodiments may be combined with each other and/or with currently-known or future-developed technologies while remaining within the scope of the claims presented here. Therefore, it is to be understood that the disclosures are not to be limited to the specific aspects disclosed and that equivalents, modifications, and other aspects are intended to be included within the scope of the appended claims. Although specific terms are employed herein, they are used in a generic and descriptive sense only and not for purposes of limitation.

That which is claimed:

1. An appliance, comprising:

a housing defining a cavity having an opening;

a cover member engaged with the housing and configured to be pivotable between an open position and closed position with respect to the opening so as to selectively allow access to the cavity through the opening; and a plurality of vents operably engaged with the housing about the opening, the plurality of vents providing first, second and third airflow manipulations, and including:

a positive pressure vent configured to direct a positive airflow therethrough in a first lateral direction across the opening for the first airflow manipulation;

a negative pressure vent configured to apply a suction in a second lateral direction across the opening so as to pull at least a portion of the positive airflow therethrough for the second airflow manipulation; and opposing first and second neutralizing vents arranged to be directed laterally across the opening to provide the third airflow manipulation, in response to pivoting of the cover member between the open and closed positions with respect to the opening, by neutralizing effects on and maintaining the positive airflow directed across the opening from the positive pressure vent and pulled through the negative pressure vent by the applied suction, caused by pivoting of the cover member between the open and closed positions, the neutralizing effects including directing a positive airflow from the neutralizing vents between the cover member and the opening, upon the cover member pivoting from the closed position to the open position, and directing a negative airflow through the first or second neutralizing vents from between the cover member and the opening, upon the cover member pivoting from the open position to the closed position.

2. The appliance of claim 1, wherein the positive pressure vent is laterally opposed to the negative pressure vent across the opening.

3. The appliance of claim 2, wherein the first and second neutralizing vents are arranged to be directed perpendicularly to the positive and negative pressure vents.

4. The appliance of claim 1, wherein each of the first and second neutralizing vents is configured to direct a positive airflow therethrough, to apply a suction therethrough, to allow egress of air from between the cover member and the opening to an exterior of the housing, or to allow ingress of air from the exterior of the housing to between the cover member and the opening, as the third airflow manipulation.

5. The appliance of claim 1, comprising a condensate trap operably engaged with the first neutralizing vent or the second neutralizing vent for removing moisture from the air directed therethrough.

6. The appliance of claim 1, comprising an actuator engaged with the cover member, with a handle associated with the cover member, with the housing, or between the cover member and the housing, the actuator being configured to actuate an airflow source for providing the positive airflow or a suction source for providing the suction, in response to the cover member being pivoted from the closed position toward the open position, and to deactuate the airflow source or the suction source in response to the cover member being pivoted to the closed position.

7. The appliance of claim 6, wherein the actuator is configured to open one or more of the plurality of vents in response to the cover member being pivoted from the closed position toward the open position, and to close the one or more of the plurality of vents in response to the cover member being pivoted to the closed position.

8. The appliance of claim 1, wherein the housing and the cover member are components of an oven, a refrigerator, a wine cooler, a freezer, an icemaker, a dishwasher, a clothes washer, a clothes dryer, or a clothes steamer.

9. An air curtain arrangement for an appliance including a housing defining a cavity having an opening, and a cover member engaged with the housing, with the cover member being configured to be pivotable between an open position and closed position with respect to the opening so as to selectively allow access to the cavity through the opening, the air curtain arrangement comprising:

a positive pressure vent configured to be operably engaged with the housing about the opening, and to direct a positive airflow therethrough in a first lateral direction across the opening;

a negative pressure vent configured to be operably engaged with the housing about the opening, and to apply a suction in a second lateral direction across the opening so as to pull at least a portion of the positive airflow therethrough; and opposing first and second neutralizing vents configured to be operably engaged with the housing about the opening, and being arranged to be directed laterally across the opening, the first and second neutralizing vents being configured to be responsive to pivoting of the cover member between the open and closed positions with respect to the opening, to neutralize effects on and maintain the positive airflow directed across the opening from the positive pressure vent and pulled through the negative pressure vent by the applied suction, caused by pivoting of the cover member between the open and closed positions, the neutralizing effects including directing a positive airflow from the neutralizing vents between the cover member and the opening, upon the cover member pivoting from the closed position to the open position, and directing a negative airflow through the neutralizing vents from between the cover member and the opening, upon the cover member pivoting from the open position to the closed position.

10. The apparatus of claim 9, wherein the positive pressure vent is laterally opposed to the negative pressure vent across the opening.

11. The apparatus of claim 10, wherein the first and second neutralizing vents are arranged to be directed perpendicularly to the positive and negative pressure vents.

12. The apparatus of claim 9, wherein each of the first and second neutralizing vents is configured to direct a positive airflow therethrough, to apply a suction therethrough, to allow egress of air from between the cover member and the opening to an exterior of the housing, or to allow ingress of air from the exterior of the housing to between the cover member and the opening.

13. The apparatus of claim 9, comprising a condensate trap operably engaged with the first neutralizing vent or the second neutralizing vent for removing moisture from the air directed therethrough.

14. The apparatus of claim 9, comprising an actuator adapted to be engaged with the cover member, with a handle associated with the cover member, with the housing, or between the cover member and the housing, the actuator being configured to actuate an airflow source for providing the positive airflow or a suction source for providing the suction, in response to the cover member being pivoted from the closed position toward the open position, and to deactuate the airflow source or the suction source in response to the cover member being pivoted to the closed position.

15. The apparatus of claim 14, wherein the actuator is configured to open one or more of the plurality of vents in response to the cover member being pivoted from the closed position toward the open position, and to close the one or more of the plurality of vents in response to the cover member being pivoted to the closed position.

16. The apparatus of claim 9, wherein the positive and negative pressure vents and the first and second neutralizing vents are configured to be received by an oven, a refrigerator, a wine cooler, a freezer, an icemaker, a dishwasher, a clothes washer, a clothes dryer, or a clothes steamer.

17. A method of manufacturing an appliance including a housing defining a cavity having an opening, and a cover member engaged with the housing and configured to be pivotable between an open position and closed position with respect to the opening so as to selectively allow access to the cavity through the opening, the method comprising:

engaging a positive pressure vent with the housing about the opening, the positive pressure vent being configured to direct a positive airflow therethrough in a first lateral direction across the opening;

engaging a negative pressure vent with the housing about the opening, the negative pressure vent being configured to apply a suction in a second lateral direction across the opening so as to pull at least a portion of the positive airflow from the positive pressure vent therethrough; and engaging opposing first and second neutralizing vents with the housing about the opening, such that the opposing first and second neutralizing vents are arranged to be directed laterally across the opening, the first and second neutralizing vents being configured to be responsive to pivoting of the cover member between the open and closed positions with respect to the opening, to neutralize effects on and maintain the positive airflow directed across the opening from the positive pressure vent and pulled through the negative pressure vent by the applied suction, caused by pivoting of the cover member between the open and closed positions, the neutralizing effects including directing a positive airflow from the neutralizing vents between the cover member and the opening, upon the cover member pivoting from the closed position to the open position, and directing a negative airflow through the neutralizing vents from between the cover member and the opening, upon the cover member pivoting from the open position to the closed position.

18. The method of claim 17, wherein engaging a negative pressure vent with the housing comprises engaging a negative pressure vent with the housing such that the negative pressure vent is laterally opposed to the positive pressure vent across the opening.

19. The method of claim 18, wherein engaging opposing first and second neutralizing vents with the housing comprises engaging opposing first and second neutralizing vents with the housing such that the first and second neutralizing vents are arranged to be directed perpendicularly to the positive and negative pressure vents.

20. The method of claim 17, wherein engaging opposing first and second neutralizing vents with the housing comprises engaging opposing first and second neutralizing vents with the housing, wherein each of the first and second neutralizing vents is configured to direct a positive airflow therethrough, to apply a suction therethrough, to allow egress of air from between the cover member and the opening to an exterior of the housing, or to allow ingress of air from the exterior of the housing to between the cover member and the opening.

21. The method of claim 17, comprising engaging a condensate trap with the first neutralizing vent or the second neutralizing vent, the condensate trap being configured to remove moisture from the air directed therethrough.

22. The method of claim 17, comprising engaging an actuator with the cover member, with a handle associated with the cover member, with the housing, or between the cover member and the housing, the actuator being configured to actuate an airflow source for providing the positive airflow or a suction source for providing the suction, in response to the cover member being pivoted from the closed position toward the open position, and to deactuate the airflow source or the suction source in response to the cover member being pivoted to the closed position.

23. The method of claim 22, wherein engaging the actuator with the cover member, with the housing, or between the cover member and the housing, comprises engaging the actuator with the cover member, with the housing, or between the cover member and the housing, such that the actuator is configured to open one or more of the plurality of vents in response to the cover member being pivoted from the closed position toward the open position, and to close the one or more of the plurality of vents in response to the cover member being pivoted to the closed position.

24. The method of claim 17, wherein engaging the positive and negative pressure vents and the first and second neutralizing vents with the housing, comprises engaging the positive and negative pressure vents and the first and second neutralizing vents with the housing of an oven, a refrigerator, a wine cooler, a freezer, an icemaker, a dishwasher, a clothes washer, a clothes dryer, or a clothes steamer.

* * * * *